US010365602B2

(12) United States Patent
Kaminaga

(10) Patent No.: US 10,365,602 B2
(45) Date of Patent: Jul. 30, 2019

(54) HOLE PUNCHING APPARATUS FOR PUNCHING PUNCH HOLES IN PRINTING PAPER

(71) Applicant: KYOCERA Document Solutions Inc., Osaka (JP)

(72) Inventor: Seiji Kaminaga, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/848,517

(22) Filed: Dec. 20, 2017

(65) Prior Publication Data

US 2018/0173149 A1 Jun. 21, 2018

(30) Foreign Application Priority Data

Dec. 20, 2016 (JP) ..... 2016-246460

(51) Int. Cl.
*G03G 15/00* (2006.01)

(52) U.S. Cl.
CPC ..... *G03G 15/6582* (2013.01); *G03G 2215/00818* (2013.01)

(58) Field of Classification Search
CPC ..... G03G 15/6582; G03G 2215/00818
See application file for complete search history.

(56) References Cited

U.S. PATENT DOCUMENTS 7,896,341 B2 * 3/2011 Kunieda ..... B42C 1/12 270/58.08
7,946,567 B2 * 5/2011 Taguchi ..... B65H 37/04 270/58.08
7,950,647 B2 * 5/2011 Iguchi ..... B21D 28/26 270/58.07
2008/0236351 A1 * 10/2008 Hidaka ..... B26D 5/34 83/73
2009/0229435 A1 * 9/2009 Iguchi ..... B21D 28/26 83/109
2011/0107886 A1 * 5/2011 Fukatsu ..... B26D 5/28 83/13
2012/0297951 A1 * 11/2012 Baba ..... B26D 5/16 83/618
2018/0173149 A1 * 6/2018 Kaminaga ..... G03G 15/6582

FOREIGN PATENT DOCUMENTS

JP 2004-345834 A 12/2004

* cited by examiner

*Primary Examiner* — Omar Flores Sanchez
(74) *Attorney, Agent, or Firm* — Hawaii Patent Services; Nathaniel K. Fedde; Kenton N. Fedde

(57) ABSTRACT

Provided is a hole punching apparatus that is capable of improving the accuracy of stopping at a target reference position. The hole punching apparatus executes a hole-punching process and a braking process, and includes a rotation-detecting unit and a brake-control unit. The hole-punching process punches punch holes by rotating a hole-punching shaft from a reference position. The brake-control unit intermittently turns ON and OFF a short-circuit brake in the braking process. The brake-control unit sets a braking period for turning ON the brake according to the rotation position and rotation speed of the hole-punching shaft that is measured based on the rotation-position signal so that the braking period tends to become longer as the rotation position becomes closer to the reference position, and tends to become longer as the rotation speed becomes faster.

8 Claims, 10 Drawing Sheets

FIG.5

| BRAKE RATIO B [%] | | PULSE PERIOD T [μsec] | | | | | |
|---|---|---|---|---|---|---|---|
| | | ~ 1000 | 1000 ~ | 2000 ~ | 3000 ~ | 4000 ~ | 5000 ~ |
| COUNT VALUE | 19 ~ 21 | 100 | 70 | 50 | 40 | 30 | 20 |
| | 22 ~ 24 | 100 | 80 | 60 | 50 | 40 | 30 |
| | 25 ~ 27 | 100 | 90 | 70 | 60 | 55 | 40 |
| | 28 ~ 30 | 100 | 100 | 80 | 75 | 70 | 50 |
| | 31 ~ 33 | 100 | 100 | 100 | 90 | 85 | 80 |
| | 34 ~ 36 | 100 | 100 | 100 | 100 | 100 | 100 |

HOLE PUNCHING APPARATUS FOR PUNCHING PUNCH HOLES IN PRINTING PAPER

INCORPORATION BY REFERENCE

This application is based on and claims the benefit of priority from Japanese Patent Application No. 2016-246460 filed on Dec. 20, 2016, the contents of which are hereby incorporated by reference.

BACKGROUND

The present disclosure relates to a hole punching apparatus for punching punch holes in printing paper.

As a hole punching apparatus for punching punch holes in printing paper, an apparatus is known that includes hole-punching blades that punch punch holes in printing paper using vertical motion, a hole-punching motor, and vertical-motion-converting units that convert the rotation of the hole-punching motor into vertical motion.

Normally, punching punch holes by a hole-punching apparatus is usually performed in a short period of time of several tens of ms, and involves a large load fluctuation. Therefore, in typical technology, a DC motor is often used as the hole-punching motor, however, a DC motor has large inertia. Consequently, even though a brake (short-circuit brake or reverse brake) is applied from a state of high-speed rotation, the motor may not stop simultaneously with the brake, and may continue to rotate due to inertia, so stopping the motor at a reference position is difficult.

Therefore, in typical technology, there is technology that, depending on the amount the motor is driven within a specified amount of time while the motor is being driven, changes the starting position for a motor stopping operation, or in other words, changes the timing when the brake is applied.

SUMMARY

The hole punching apparatus according to the present disclosure is a hole punching apparatus that includes hole-punching blades, a hole-punching motor, and vertical-motion-converting units, and executes a hole-punching process and a braking process. The hole-punching blades punch punch holes in printing paper by vertical motion. The vertical-motion-converting units convert rotation of a hole-punching shaft that is connected to the hole-punching motor to vertical motion of the hole-punching blades. The hole-punching process punches punch holes by rotating the hole-punching shaft from a reference position. The braking process applies a brake to the rotation of the hole-punching shaft and stops at the reference position. The hole punching apparatus further includes a rotation-detecting unit and a brake-control unit. The rotation-detecting unit detects the rotation of the hole-punching shaft and outputs a rotation-position signal. The brake-control unit intermittently turns ON and OFF the brake in the braking process. The brake-control unit sets a braking period for turning ON the brake according to the rotation position and rotation speed of the hole-punching shaft that is measured based on the rotation-position signal so that the braking period tends to become longer as the rotation position becomes closer to the reference position. Moreover, the brake-control unit sets a braking period for turning ON the brake so that the braking period tends to become longer as the rotation speed becomes faster.

BRIEF DESCRIPTION OF THE DRAWINGS

FIG. 5 illustrates an example of the brake-ratio-calculation table illustrated in FIG. 4.

DETAILED DESCRIPTION

Next, an embodiment according to the present disclosure will be explained in detail with reference to the drawings.

Figure 1:
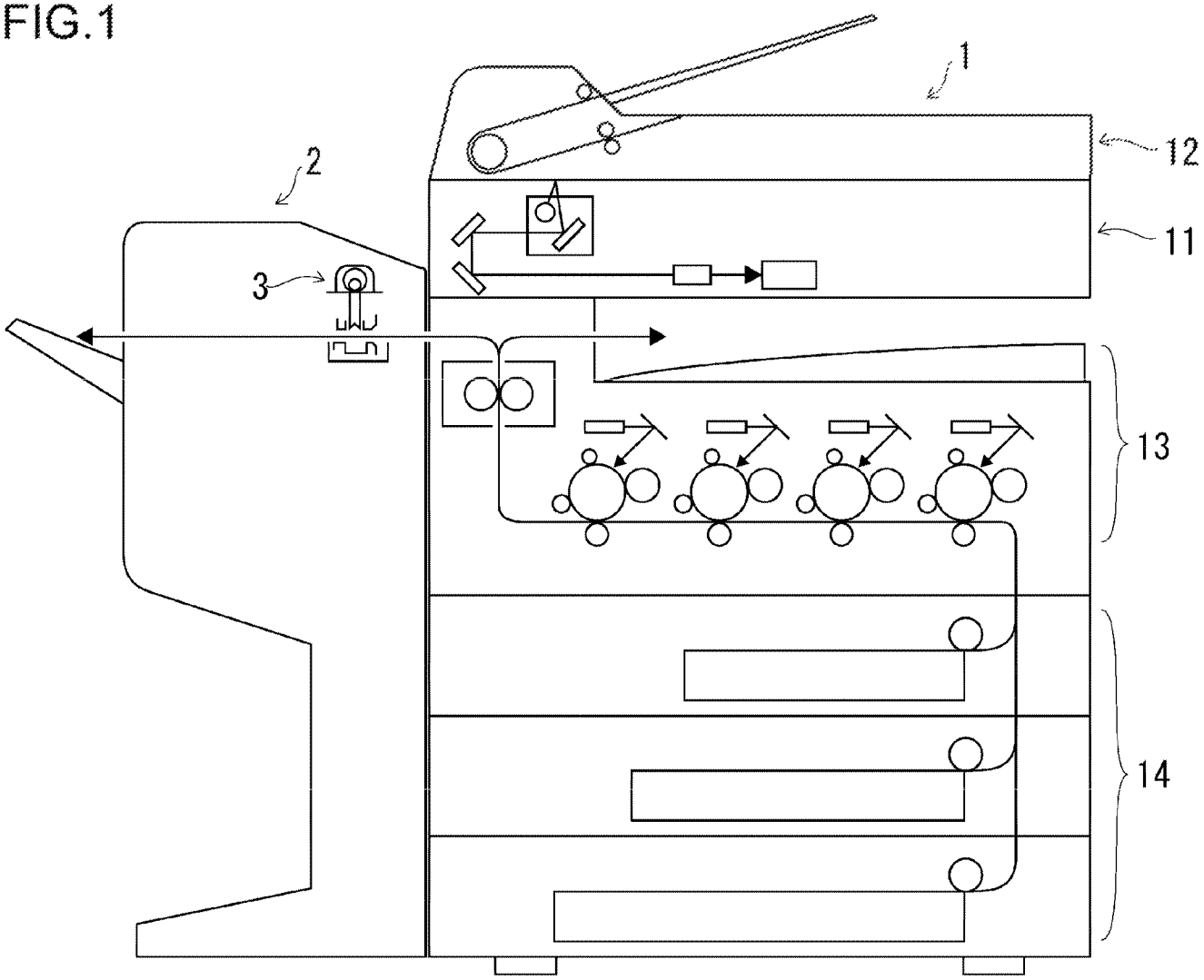
FIG. 1 is a system configuration diagram illustrating the configuration of an image forming system that includes a post processing apparatus having a hole punching apparatus of an embodiment according to the present disclosure, and an image forming apparatus.

The image forming system of this embodiment, as illustrated in FIG. 1, includes an image forming apparatus that prints and outputs an image that is formed on printing paper, and a post-processing apparatus 2 that receives printing paper that is outputted from the image forming apparatus 1 and executes various post-processing on the received printing paper.

The image forming apparatus 1 is a copier, MFP (Multi-function Peripheral/Printer/Product) or the like that uses an electrophotographic method, and includes a document-reading unit 11, a document-feeding method 12, an image-forming unit 13, and a printing-paper-supply unit 14. The image forming apparatus 1 executes an image-forming operation such as a copying job, a scanning job, a facsimile transmitting job, a printing job and the like based on an operation that is received in a logged-in state by user authentication.

The document-reading unit 11 includes a light source that irradiates light onto a document that is set on a platen glass, or onto a document that is fed from the document-feeding unit 12, and a photoelectric conversion unit such as a CCD or the like that converts reflected light from that document into image data of the document.

The image-forming unit 13 forms a toner image based on printing data, transfers the formed toner image onto printing paper that is conveyed from the printing-paper-supply unit 14, and fixes the toner image that is transferred to the printing paper at a specified fixing temperature.

The post-processing apparatus 2 includes a hole punching apparatus 3. The post-processing apparatus 2 may also include a stapling apparatus that stacks plural sheets of printing paper and staples the sheets together, a center folding apparatus that folds printing paper, and the like.

Figure 2:
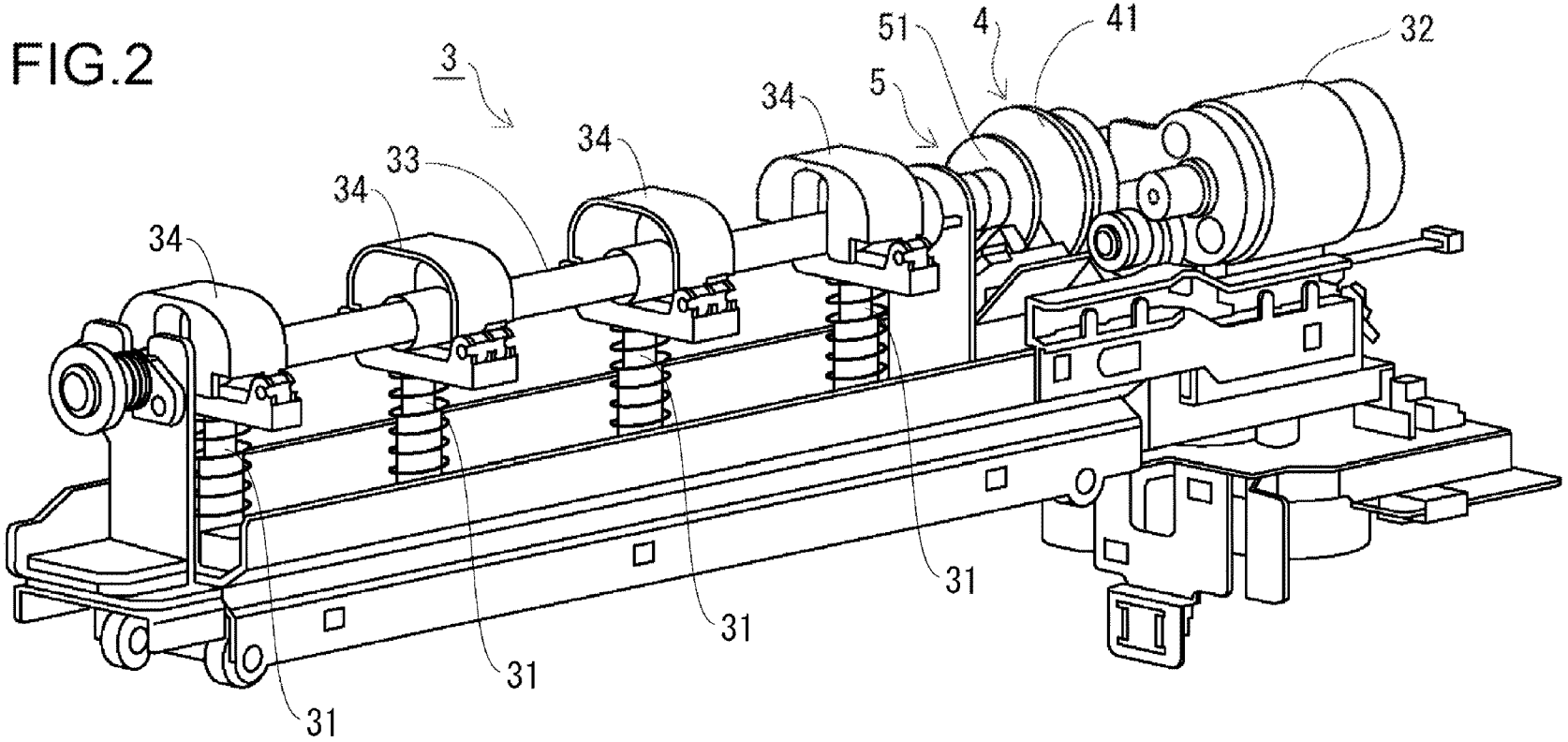
FIG. 2 is a perspective view illustrating the configuration of the hole punching apparatus illustrated in FIG. 1.

The hole punching apparatus 3, referring to FIG. 2, includes hole-punching blades 31, a hole-punching motor 32, a hole-punching shaft 33, vertical-motion-converting units 34, a rotation-detecting unit 4, and a reference-position-detecting unit 5. The hole-punching blades 31 are arranged a specified intervals in the width direction of the printing paper, and punch punch holes in the printing paper by vertical motion. The hole-punching shaft 33 is connected to the rotating shaft of the hole-punching motor 32 via a gear train. The vertical-motion-converting units 34 convert the rotation of the hole-punching shaft 33 to vertical motion of the hole-punching blades 31.

The vertical-motion-converting units 34, for example, causes the hole-punching blades 31 to move vertically as the hole-punching shaft 33 rotates by causing the perimeter of eccentric cams that are supported by the hole-punching shaft 33 to engage with support members that support the hole-punching blades 31. In this case, a hole-punching process for punching punch holes is executed by the rotation of the hole-punching shaft 33 causing the perimeter edges that are far from the center of rotation of the eccentric cams to engage with the support members of the hole-punching blades 31. Then, the perimeter edges that are near the center of rotation of the eccentric cams engage with the support members of the hole-punching blades 31, and this state in which the hole-punching blades 31 are not in contact with the printing paper becomes the reference position for waiting in preparation for the next hole-punching process.

Figure 3:
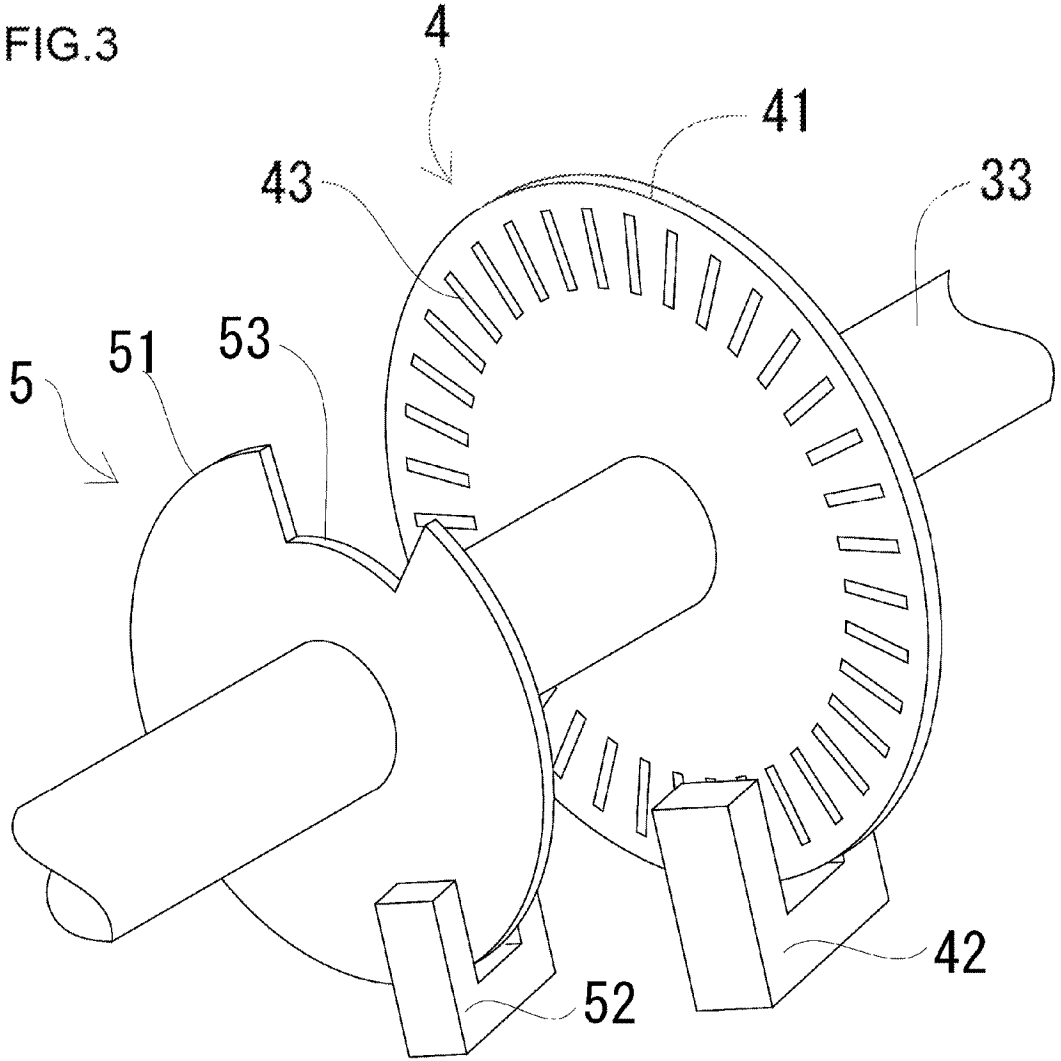
FIG. 3 is a perspective view illustrating the configuration of the rotation-detecting unit and reference-position-detecting unit illustrated in FIG. 2.

The rotation-detecting unit 4 is a detecting unit for detecting the rotation of the hole-punching shaft 33 (eccentric cams). The rotation-detecting unit 4, referring to FIG. 2 and FIG. 3, includes a pulse plate 41 that is attached to one end section side of the hole-punching shaft 33, and a rotation-amount-detecting sensor 42 that is configured using a transmission-type photo interrupter or the like.

The pulse plate 41 is formed into a disk shape, and the hole-punching shaft 33 passes through the center. Plural slit holes 43 are formed in the pulse plate 41 so as to be uniformly arranged around the entire circumferential range in the circumferential direction. The rotation-amount-detecting sensor 42 is arranged at a position facing the rotational locus of the plural slit holes 43, and outputs pulses according to whether or not there is a slit hole 43 (whether light passes through or is blocked) as a rotation position signal. In this embodiment, 36 slit holes 43 are formed in the pulse plate 41, and the rotation-amount-detecting sensor 42 detects the 36 slit holes 43 every 10 degrees when the pulse plate 41 is rotated one rotation. As a result, the rotation position signal that is outputted from the rotation-detecting unit 4 becomes a pulse signal that outputs a pulse every 10 degrees of rotation of the hole-punching shaft 33.

The reference-position-detecting unit 5 is a detecting unit for detecting the reference position of the hole-punching shaft 33 (eccentric cam). Referring to FIG. and FIG. 3, the reference-position-detecting unit 5 includes a reference-position-detecting plate 51 that is attached to one end section side of the hole-punching shaft 35, and a reference-position-detecting sensor 52 that is configured using a transmission-type photo interrupter or the like.

The reference-position-detecting plate 51 is formed into a disk shape and the hole-punching shaft 33 passes through the center. A cut out notch section 53 for detecting the reference position is formed in the reference-position-detecting plate 51. The cut out notch section 53 is formed over an angle of the amount of plural slit holes 43 in the pulse plate 41. The reference-position-detecting sensor 52 is arranged at a position that faces the rotation locus of the cut out notch section 53, and outputs pulses as a reference-position signal according to whether or not there is the cut out notch section 53 (whether light passes through or is blocked). The reference-position-detecting sensor 52 outputs one pulse every time the reference-position-detecting plate 51 rotates one time. In this embodiment, after the cut out notch section 53 is detected by the reference-position-detecting sensor 52, the position where 2 slit holes 43 are detected by the rotation-amount-detecting sensor 42 is set as the reference position.

Figure 4:
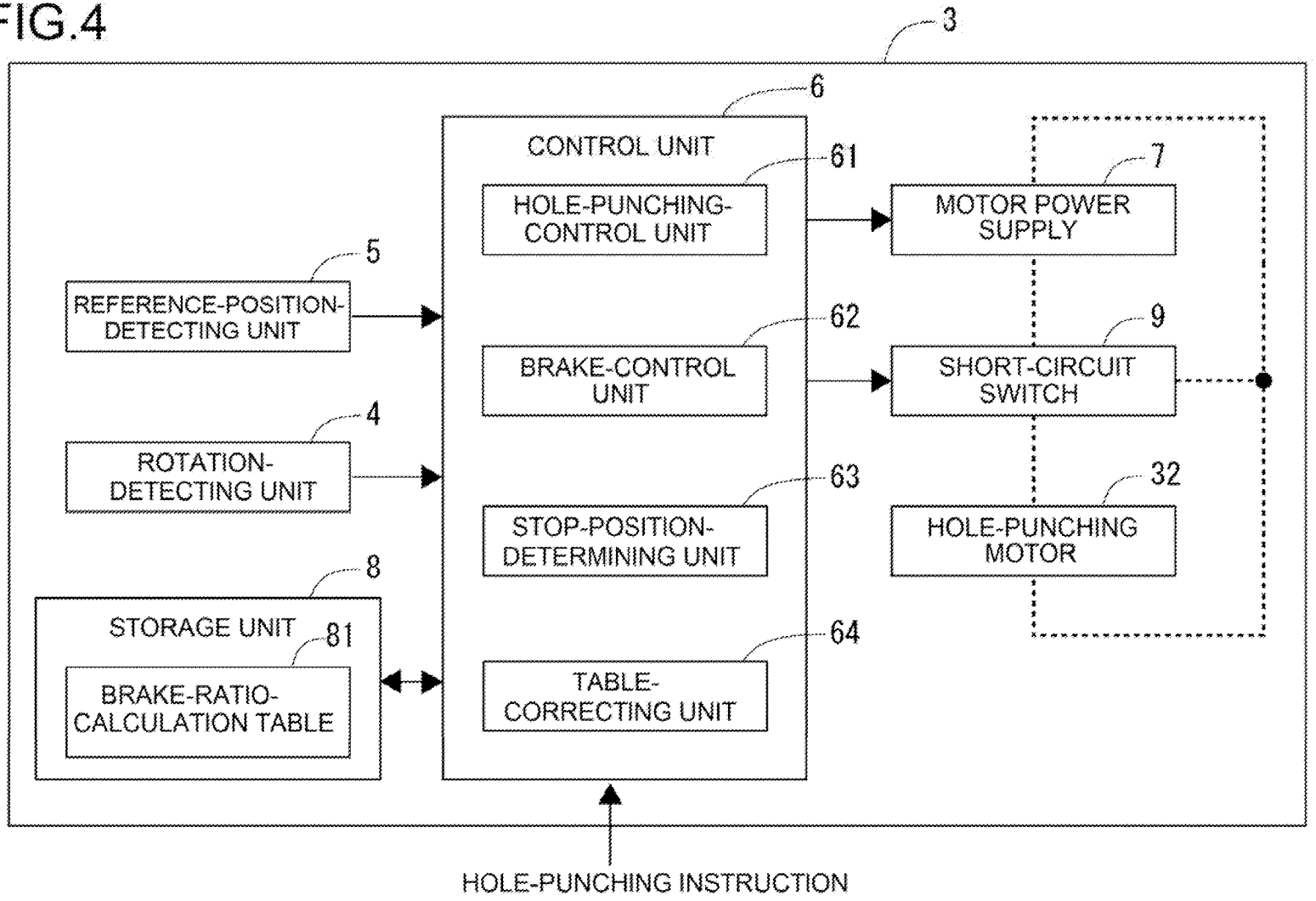
FIG. 4 is a block diagram that schematically illustrates the configuration of an embodiment of a hole punching apparatus according to the present disclosure.
Figure 6:
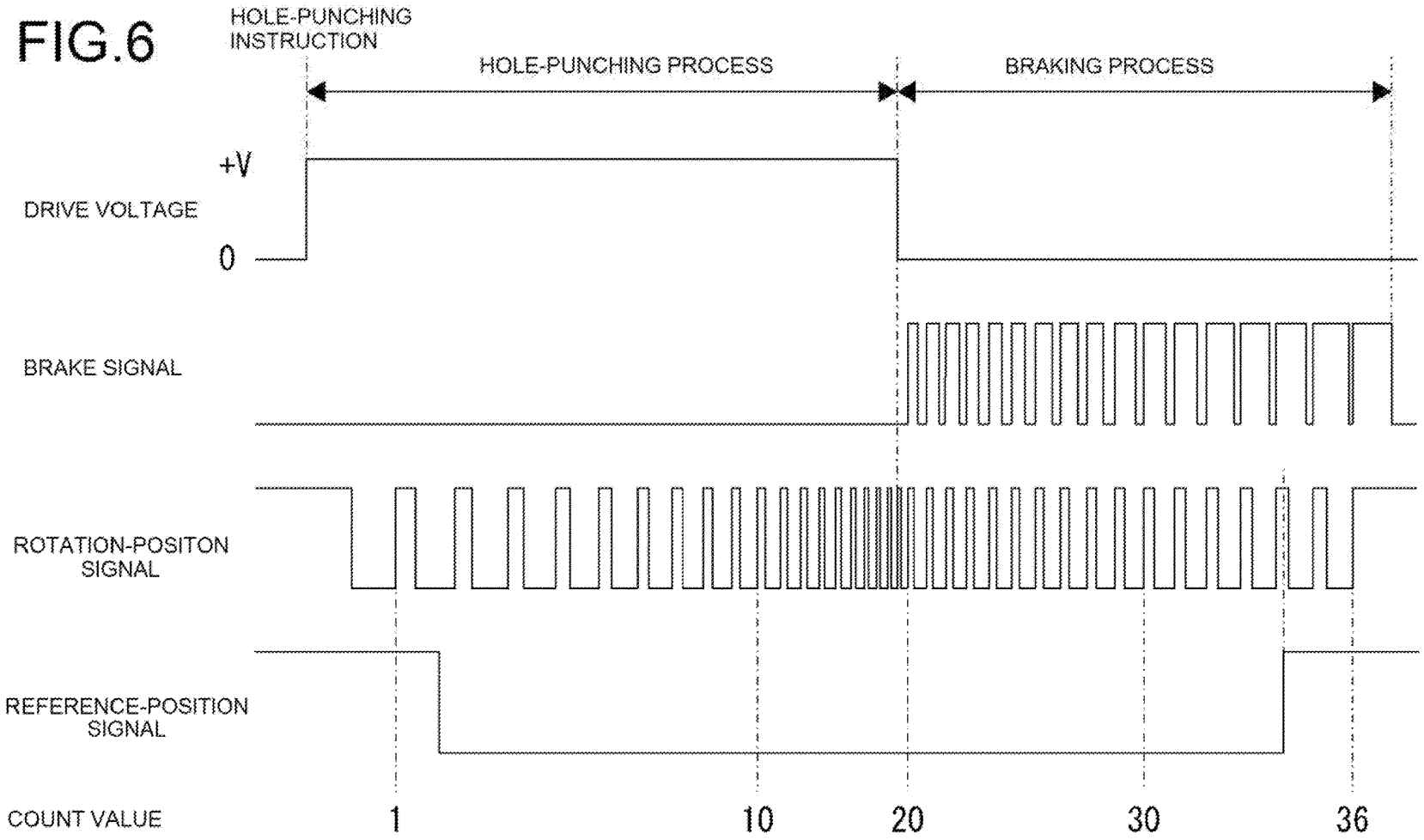
FIG. 6 is a waveform diagram for explaining a hole-punching process and braking process of an embodiment of a hole punching apparatus according to the present disclosure.

FIG. 4 is a block diagram that illustrates the schematic configuration of the hole punching apparatus 3.

The hole punch apparatus 3, in addition to the configuration described above, includes a motor power supply 7 for supply electricity to the hole-punching motor 32, a storage unit 8, and a short-circuit switch 9.

The control unit 6 is an image-processing unit such as a microcomputer or the like that includes a CPU (Central Processing Unit), a ROM (Read Only Memory), a RAM (Random Access Memory) and the like. A control program for performing operation control of the hole punching apparatus 3 is stored in the ROM. The CPU of the control unit 6 performs overall control of the apparatus by reading the control program that is stored in to ROM and expanding the control program in in the RAM. Moreover, the control unit 6 functions as a hole-punching-control unit 61, a brake-control unit 62, a stop-position-determining unit 63 and a table-correcting unit 64.

The storage unit 8 is a storage unit such as a semiconductor memory, a HDD (Hard Disk Drive) or the like, and stores a brake-ratio-calculation table 81. In the brake-ratio-calculation table 81, as illustrated in FIG. 5, brake ratios B are set according to the rotation position and rotation speed of the hole-punching shaft 33. The rotation position of the hole-punching shaft 33 is measured by counting the pulses of the rotation-position signal that is outputted from the rotation-detecting unit 4. Moreover, the rotation speed of the hole-punching shaft 33 is measured by measuring the pulse period T of the rotation-position signal that is outputted from the rotation-detecting unit 4. A brake ratio B in the brake-ratio-calculation table 81 is set so as to tend to become a larger value as the rotation position becomes closer to the reference position (36 counts), and is set so as to tend to become a larger value as the rotation speed becomes faster.

The short-circuit switch 9 is a switch for short-circuiting the terminal of the hole-punching motor 32, and applying a short-circuit brake.

The hole-punching-control unit 61 executes a hole-punching process for punching punch holes by rotating the hole-punching shaft 33 from the reference position. When a hole-punching instruction is inputted from a higher level apparatus, the hole-punching-control unit 61 causes positive voltage to be supplied from the motor power supply 7 to the hole-punching motor 32, and starts the hole-punching process. Moreover, as the hole-punching process starts, the hole-punching-control unit 61 starts counting the pulses of the rotation-position signal that is outputted from the rotation-detecting unit 4. Then, when the count value of pulses reaches a preset value (in this embodiment, a count of 19), the hole-punching-control unit 61 stops the supply of voltage from the motor power supply 7 to the hole-punching motor 32, and ends the hole-punching process.

The brake-control unit 62 executes a braking process for applying a brake to the rotation of the hole-punching shaft 33 and stopping at the reference position. The brake-control unit 62 turns ON the short-circuit switch 9 according to the measured rotation position and the rotation speed of the hole-punching shaft 33, and sets the braking period for applying the short-circuit brake. In this embodiment, a short-circuit brake is used as the brake, however, a reverse brake that supplies a negative voltage from the motor power supply 7 to the hole-punching motor 32 may also be used.

The braking-control unit 62, first, based on the rotation-position signal that is outputted from the rotation-detecting unit 4, measures the rotation position of the hole-punching shaft 33 according to the pulse count, and measures the rotation speed of the hole-punching shaft 33 by measuring the pulse period T. Next, the braking-control unit 62, by referencing the brake-ratio-calculating table 81 that is stored in the storage unit 8, identifies a brake ratio B according to the measured rotation position and rotation speed of the hole-punching shaft 33. Next, the braking-control unit 62 calculates the value that is obtained by multiplying the measure pulse period T with the identified brake ratio B as the braking period. As a result, the braking period is set so as to tend to become longer as the rotation position becomes closer to the reference position (36 counts), and set so as to tend to become longer as the rotation speed becomes faster.

The stop-position-determining unit 63 determines whether or not the hole-punching shaft 33 is stopped at the reference position by the braking process of the braking-control unit 62. Then, when it is determined that the hole-punching shaft 33 is not stopped at the reference position, the stop-position-determining unit 63 causes a positive or negative voltage to be supplied from the motor power supply 7 to the hole-punching motor 32, and corrects the rotation position of the hole-punching shaft 33. Moreover, when it is determined that the hole-punching shaft 33 is not stopped at the reference position, the stop-position-determining unit 63 instructs the table-correcting unit 64 to correct the brake-ratio-calculation table 81.

The table-correcting unit 64 corrects the brake ratios B in the brake-ratio-calculation table 81 based on the instruction from the stop-position-determining unit 63.

Next, the hole-punching process and the braking process by the hole-punching apparatus 3 will be explained in detail with reference to FIG. 6 to FIG. 8C.

When a hole-punching instruction is inputted from a higher level apparatus, the control unit 6 functions as the hole-punching-control unit 61. The hole-punching-control unit 61 causes the supply of a positive voltage from the motor power supply 7 to the hole-punching motor 32 to start, and starts the execution of the hole-punching process. As a result, the hole-punching shaft 33 rotates, and by the perimeter edges that are far from the center of rotation of the eccentric cams engaging with the support members of the hole-punching blades 31, the hole-punching blades 31 are driven toward the printing paper and punch punch holes.

Moreover, as the hole-punching process starts, the hole-punching-control unit 61 starts counting the pulses of the rotation-position signal that is outputted from the rotation-detecting unit 4. Then, when the value of the pulse count reaches 19 counts, the hole-punching-control unit 61 stops the supply of voltage from the motor power supply 7 to the hole-punching motor 32 and ends the hole-punching process.

Figure 7:
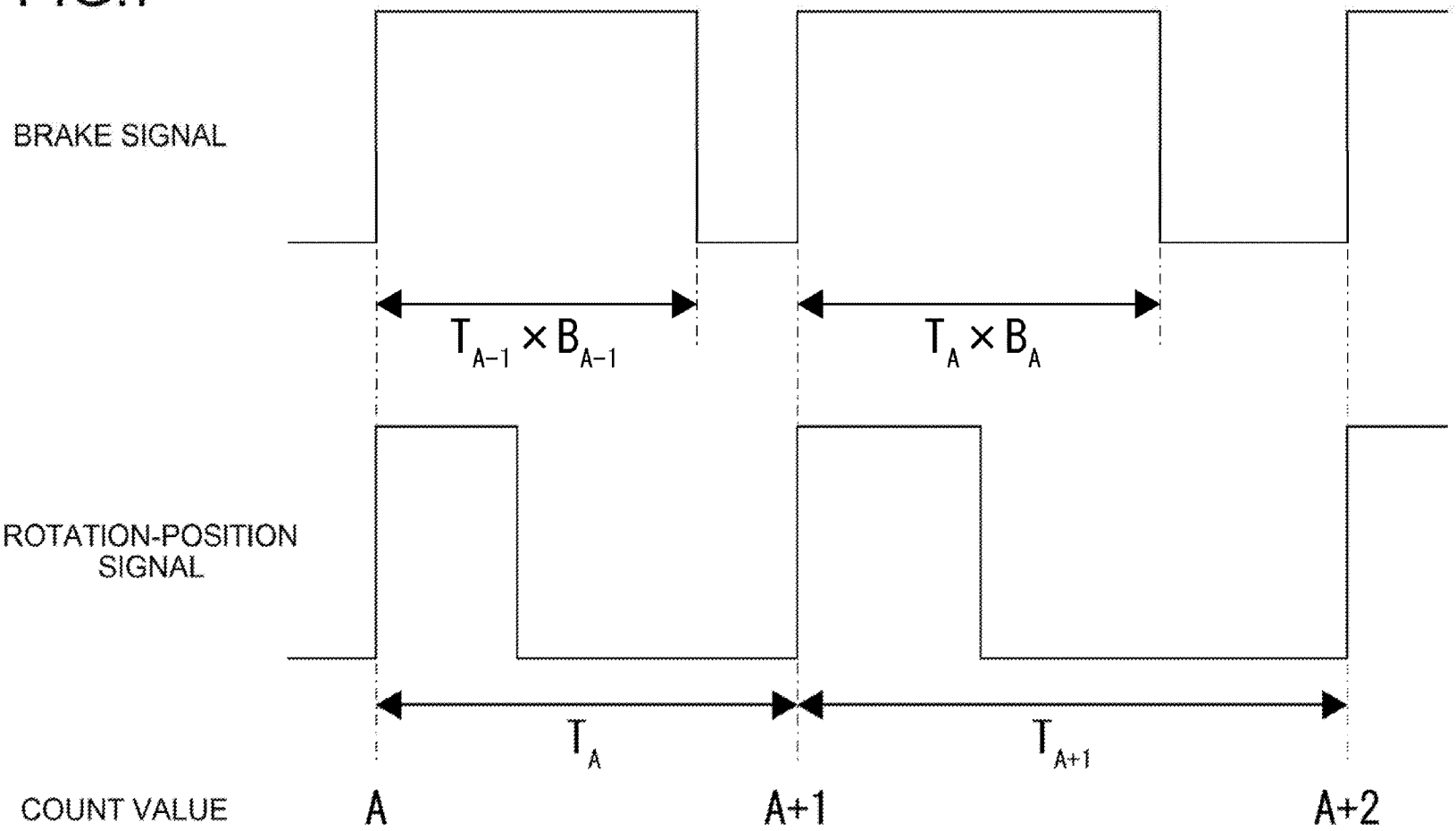
FIG. 7 is a waveform diagram for explaining the braking-period-calculating process in the braking process illustrated in FIG. 6.

After the hole-punching process is ended by the hole-punching-control unit 61, the control unit 6 functions as a braking-control unit 62. The braking-control unit 62, as illustrated in FIG. 7, based on the rotation-position signal that is outputted from the rotation-detecting unit 4, measures the rotation position of the hole-punching shaft 33 according the pulse count value A, and measures the rotation speed of the hole-punching shaft 33 by measuring the pulse period $T_A$.

Next, the braking-control unit 62, by referencing the brake-ratio-calculation table 81 of a storage unit 8, identifies the brake ratio $B_A$ according to the measured rotation position and rotation speed of the hole-punching shaft 33, or in other words, according to the count value A and pulse period $T_A$.

Next, the braking-control unit 62 calculates the value obtained by multiplying the measured pulse period $T_A$ by the identified brake ratio $B_A$ ($T_A \times B_A$) as the braking period in the next pulse period $T_{A+1}$ of the next count value A+1.

Then, the braking-control unit 62 turns ON the short-circuit switch 9 and applies a short-circuit brake only during the braking period ($T_A \times B_A$) that is calculated at the next pulse period $T_{A+1}$ of the next count value A+1. As a result, at the pulse period $T_{A+1}$ of the count value A+1, the terminal of the hole-punching motor 32 becomes open during the non-braking period {Pulse period $T_{A+1}$−Braking period ($T_A \times B_A$)} when the short-circuit switch 9 is turned OFF, and the hole-punching shaft 33 rotates due to inertia.

Hereinafter, in the braking process, the braking period and non-braking period are repeated and the short-circuit switch 9 is intermittently turned ON and OFF. As a result, in the braking process, a short-circuit brake is intermittently applied, and due to optimum speed attenuation, the hole-punching shaft 33 can be accurately stopped at the reference position.

Next, the control unit 6 functions as the stop-position-determining unit 63, and determines whether or not the hole-punching shaft 33 has been stopped at the reference position by the braking process.

Figure 8A:
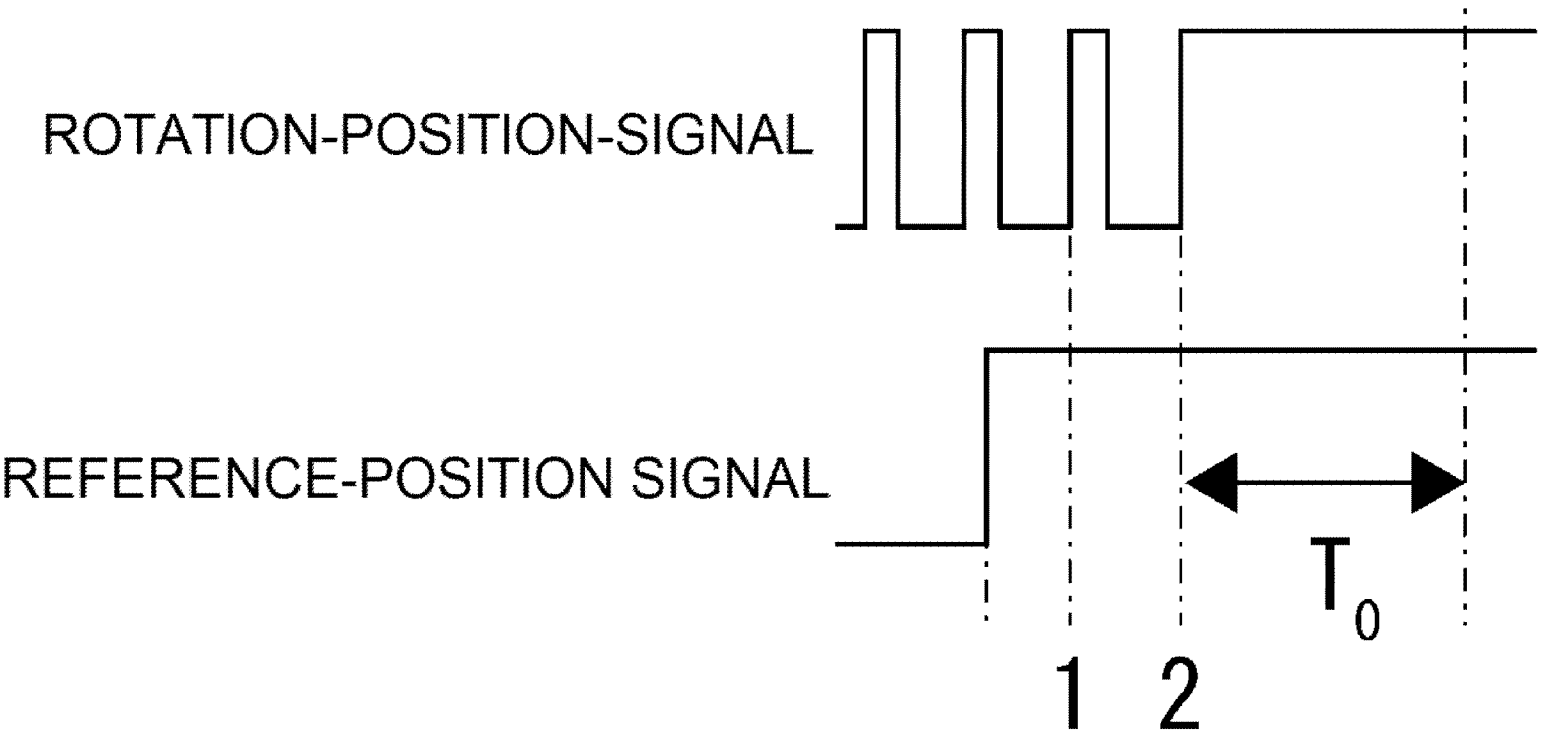
FIG. 8A is a waveform diagram for explaining the position-correcting operation in the braking process illustrated in FIG. 6.

The stop-position-determining unit 63, as illustrated in FIG. 8A, determines that after the cut out notch section 53 is detected by the reference-position-detecting sensor 52 and reference-position signal becomes high level, two slits 43 are detected by the rotation-amount-detecting sensor 42, and the rotation-position signal rises twice. After that, when no fall is detected in the next rotation-position signal even though a preset elapsed period $T_0$ has elapsed, the stop-position-determining unit 63 determines that the hole-punching shaft 33 has stopped at the reference position and ends the hole-punching process.

Figure 8B:
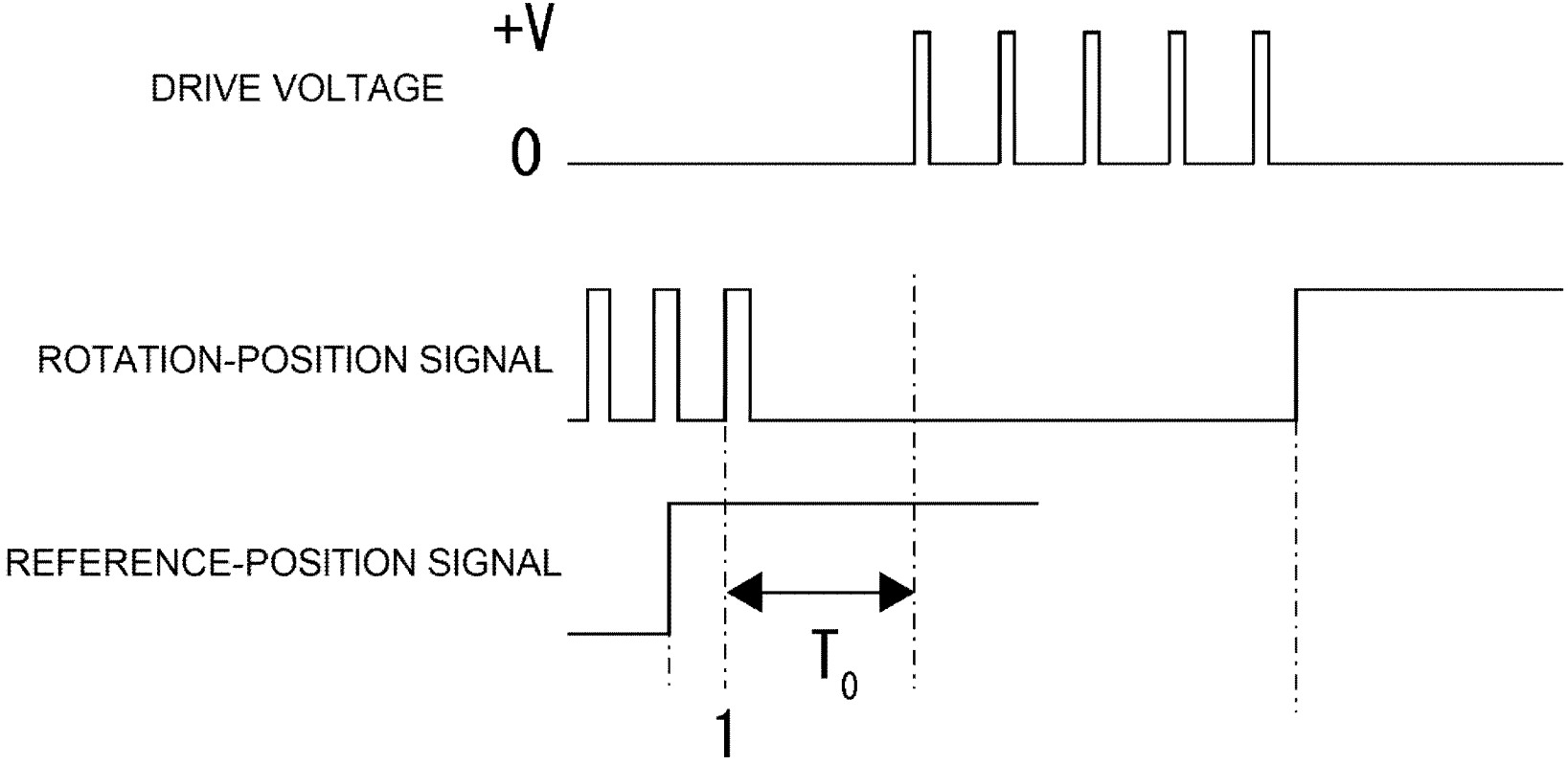
FIG. 8B is a waveform diagram for explaining the position-correcting operation in the braking process illustrated in FIG. 6.

The stop-position-determining unit 63, as illustrated in FIG. 8B, determines that, after the cut out notch section 53 is detected by the reference-position-detecting sensor 52 and the reference-position signal has become high level, two slits 43 are detected by the rotation-amount-detecting sensor 42, and the elapsed time $T_0$ has elapsed before the rotation-position signal rises two times. In this case, the stop-position-determining unit 63 determines that the hole-punching shaft 33 has stopped before the reference position, and corrects the rotation position of the hole-punching shaft 33. When the hole-punching shaft 33 stops before the reference position, the stop-position-determining unit 63 causes positive voltage (+V) to be intermittently supplied from the motor power supply 7 to the hole-punching motor 32 until the hole-punching shaft 33 reaches the reference position.

Figure 8C:
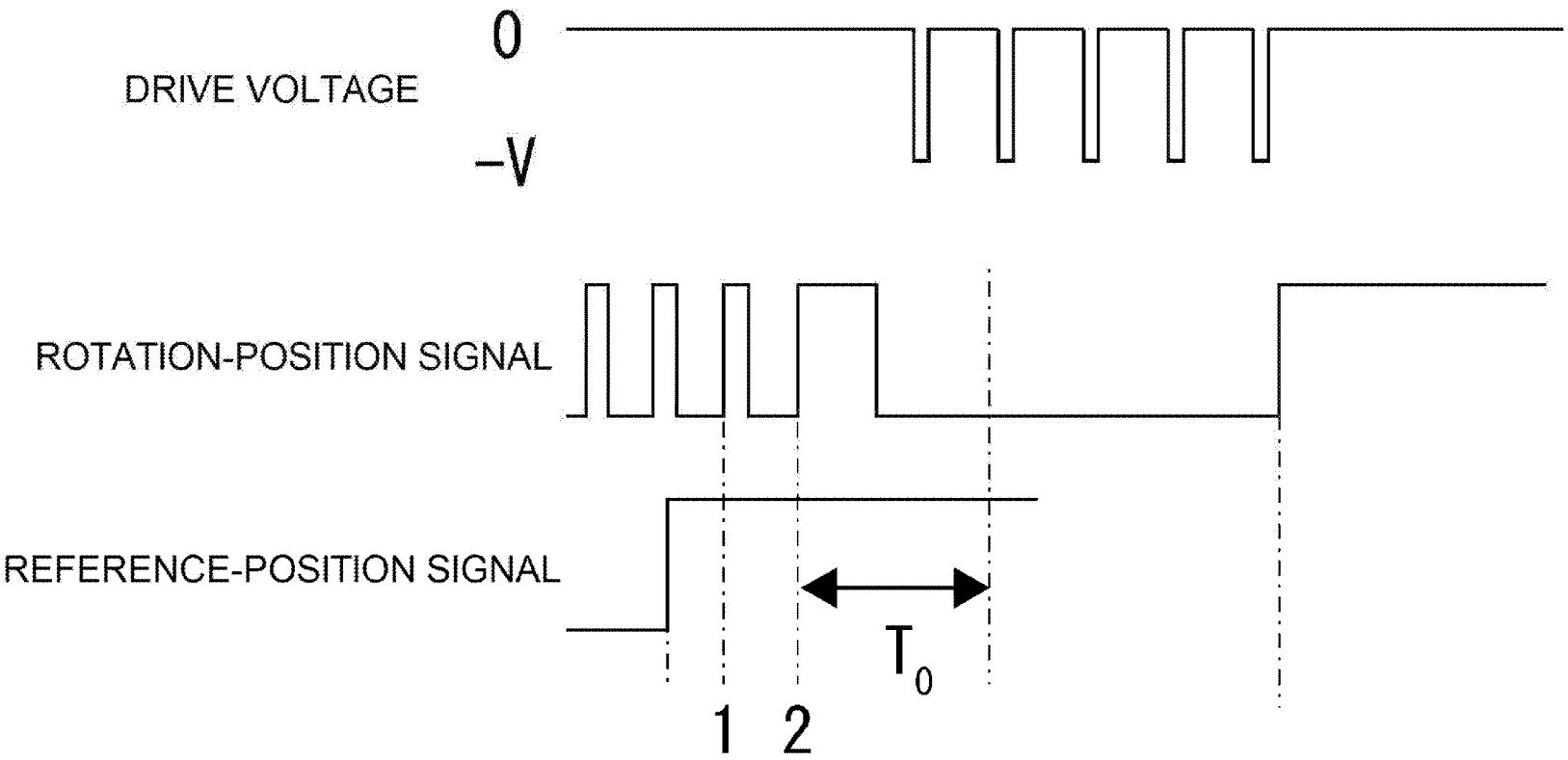
FIG. 8C is a waveform diagram for explaining the position-correcting operation in the braking process illustrated in FIG. 6.

The stop-position-determining unit 63, as illustrated in FIG. 8C, determines that after the cut out notch section 53 is detected by the reference-position-detecting sensor 52 and the reference-position signal becomes high level, two or more slits 43 are detected by the rotation-amount-detecting sensor 42, and the rotation-position signal rises two times. After that, when a fall of the next rotation-position signal are detected before elapsed period $T_0$ has elapsed, the stop-position-determining unit 63 determines that the hole-punching shaft 33 has passed the reference position and stopped, and corrects the rotation position of the hole-punching shaft 33. When the hole-punching shaft 33 passed the reference position and stopped, the stop-position-determining unit 63 causes a negative voltage (−V) to be intermittently applied from the motor power supply 7 to the hole-punching motor 32 until the hole-punching shaft 33 returns to the reference position.

Moreover, when the hole-punching shaft 33 does not stop at the reference position, the stop-position-determining unit 63 instructs the table-correcting unit 64 to correct the brake-ratio-calculation table 81.

When the hole-punching shaft 33 stopped before the reference position, the table-correcting unit 64 corrects the brake ratio B of the brake-ratio-correction table 81 in the direction so as to become smaller. When the hole-punching shaft 33 passed the reference position and stopped, the table-correcting unit 64 corrects the brake ratio B of the brake-ratio-correction table 81 in the direction so as to become larger.

As an example of the method for correcting the brake ratio B, the brake ratios B of the brake-ratio-calculation table 81 are uniformly increased or decreased (by a specified ratio or specified value). In this case, the identified brake ratios B may be uniformly increased or decreased without changing the brake-ratio-calculation table 81 itself. In the brake-ratio-calculation table 81 illustrated in FIG. 5, the maximum value of the brake ratio B is 100%, however, the braking period that calculated using the brake ratio B is for the next decelerated pulse period T, so the brake ratio can be set to 100% or greater.

Another example of a method for correcting the brake ratio B is to increase or decrease only the brake ratios B in the brake-ration-calculation table 81 that correspond to a slow rotation speed. In this case, it is possible to control the stop position of the hole-punching shaft 33 within a narrower range.

As was explained above, according to this embodiment, the hole punching apparatus 3 includes hole-punching blades 31, a hole-punching motor 32 and vertical-motion-converting units 34, and is a hole-punching apparatus 3 that executes a hole-punching process and a braking process. The hole-punching blades punch punch holes in printing paper by vertical motion. The vertical-motion-converting units 34 convert the rotation of the hole-punching shaft 33 that is connected to the hole-punching motor 32 to vertical motion of the hole-punching blades 31. The hole-punching process punches punch holes by causing the hole-punching shaft 33 to rotate from the reference position. The braking process applies a brake to the rotation of the hole-punching shaft 33 and stops at the reference position. The hole punching apparatus 3 includes a rotation-detecting unit 4 and a brake-control unit 62. The rotation-detecting unit 4 detects the rotation of the hole-punching shaft 33 and outputs a rotation-position signal. The brake-control unit 62 intermittently turns ON and OFF the short-circuit brake in the braking process. The brake-control unit 62 sets the braking period that turns ON the brake according to the rotation position and the rotation speed of the hole-punching shaft 33 that are measured based on the rotation-position signal to tend to become longer as the rotation position becomes closer to the reference position, and sets the braking period to tend to become longer as the faster the rotation speed becomes faster.

With this configuration, in the braking process, it is possible to perform optimal speed attenuation according to the rotation position and the rotation speed, and thus it is possible to improve the accuracy of stopping at a target reference position.

Furthermore, according to this embodiment, the rotation-position signal is a pulse signal that outputs a pulse every specified angle of rotation of the hole-punching shaft 33. The brake-control unit 62 respectively measures the rotation position A of the hole-punching shaft 33 according to the pulse count of the rotation-position signal, and the rotation speed of the hole-punching shaft 33 according to the pulse period $T_A$ of the rotation-position signal, then sets the braking period in the nest pulse period $T_{A+1}$.

With this configuration, for every pulse period $T_A$ of the rotation-position signal, it is possible to set an optimum braking period for the next pulse period $T_{A+1}$, so it possible to perform accurate speed attenuation.

Furthermore, according to this embodiment, the hole punching apparatus 3 includes a brake-ratio-calculation table 81 in which brake ratios B are set according to the rotation position and rotation speed. Moreover, the brake-control unit 62 sets the braking period ($T_A \times B_A$) in the next pulse period $T_{A+1}$ by referencing the brake-ratio-calculation table 81 and multiplying the pulse period $T_A$ by the identified brake ratio $B_A$.

With this configuration, it is possible to set the braking period ($T_A \times B_A$) in the next pulse period $T_{A+1}$ according to the pulse period $T_A$, so it possible to perform more accurate speed attenuation.

Furthermore, according to this embodiment, the hole punching apparatus 3 includes a stop-position-determining unit 63 and a table-correcting unit 64. The stop-position-determining unit 63 determines whether or not the hole-punching shaft 33 is stopped at the reference position by the braking process. When the stop-position-determining unit 63 determines that that hole-punching shaft 33 stopped before the reference position, the table-correcting unit 64 corrects the brake ratios B in the brake-ratio-calculation table 81 in a direction so as to be come smaller. Moreover, when the stop-position-determining unit 63 determines that that hole-punching shaft 33 passed the reference position and stopped, the table-correcting unit 64 corrects the brake ratios B in the brake-ratio-calculation table 81 in a direction so as to be come larger.

With this configuration, it is possible to correct large variation in the braking force of the hole-punching motor 32 due to environment and deterioration.

Furthermore, according to this embodiment, the table-correcting unit 64 uniformly increases or decreases the brake ratios B of the brake-ratio-correction table 81.

With this configuration, it is possible to handle correction by uniformly increasing or decreasing the identified brake ratios B without changing the bake-ratio-calculation table 81 itself.

Furthermore, according to this embodiment, the table-correcting unit 64 increases or decreases only the brake ratios B in the brake-ratio-calculation table 81 that correspond to slow rotation speed.

With this configuration, it is possible to control the stop position of the hole-punching shaft 33 within a narrower range.

In typical technology described above, the amount of braking applied differs depending on the variations in the characteristics of the parts of the DC motor, or temperature conditions, so there is a problem in that it is not possible to stop the DC motor at a target reference position with good accuracy by simply changing the timing when the brake is applied. Therefore, it is necessary to move to the target reference position again after stopping, which causes a decrease in productivity.

According to the technology of the present disclosure, there is an advantage in that in the braking process it is possible to perform optimum speed attenuation according to the rotation position and rotation speed, and it is possible to improve the accuracy of stopping at a target reference position.

The technology according to the present disclosure is not limited to the embodiments above, and it is clear that the embodiments may be appropriately modified within the range of the technical ideal of the present disclosure.

What is claimed is:

1. A hole punching apparatus, comprising:

hole-punching blades for punching punch holes in printing paper by vertical motion, a hole-punching motor, and vertical-motion-converting units for converting rotation of a hole-punching shaft that is connected to the hole-punching motor to vertical motion of the hole-punching blades; and that executes:

a hole-punching process for punching punch holes by rotating the hole-punching shaft from a reference position; and a braking process that applies a brake to the rotation of the hole-punching shaft and stops at the reference position; wherein the hole punching apparatus further comprises:

a rotation-detecting unit that detects the rotation of the hole-punching shaft and outputs a rotation-position signal; and a brake-control unit that intermittently turns ON and OFF the brake in the braking process; wherein the brake-control unit sets a braking period for turning ON the brake according to the rotation position and rotation speed of the hole-punching shaft that is measured based on the rotation-position signal so that, with respect to a particular rotation speed, the braking period tends to become longer as the rotation position becomes closer to the reference position, and so that, with respect to a particular rotation position, the braking period tends to become longer as the rotation speed becomes faster.

2. The hole punching apparatus according to claim 1, wherein the rotation-position signal is a pulse signal that outputs a pulse every time the hole-punching shaft rotates a specified angle; and the brake-control unit respectively measures the rotation position of the hole-punching shaft according to a pulse count of the rotation-position signal, and the rotation speed of the hole-punching shaft according to a pulse period of the rotation-position signal, and sets the braking period in the next pulse period.

3. The hole punching apparatus according to claim 2, further comprising a brake-ratio-calculation table in which brake ratios are set according to the rotation position and the rotation speed; wherein the brake-control unit sets the braking period in the next pulse period by referencing the brake-ratio-calculation table and multiplying identified brake ratios by the pulse period.

4. The hole punching apparatus according to claim 3, further comprising:

a stop-position-determining unit that determines whether or not the hole-punching shaft was stopped at the reference position by the brake process; and a table-correcting unit that:

when the stop-position-determining unit determines that the hole-punching shaft stopped before the reference position, corrects the brake ratios of the brake-ratio-calculation table in a direction so as to become smaller; and when the stop-position-determining unit determines that the hole-punching shaft passed the reference position and stopped, corrects the brake ratios of the brake-ratio-calculation table in a direction so as to become larger.

5. The hole punching apparatus according to claim 4, wherein the table-correcting unit uniformly increases or decreases the brake ratios of the brake-ratio-correction table.

6. The hole punching apparatus according to claim 4, wherein the table-correcting unit increases or decreases only the brake ratios of the brake-ratio-correction table that correspond to a slow rotation speed.

7. A post processing apparatus comprising the hole punching apparatus according to claim 1, and that receives printing paper and performs post processing on the printing paper, wherein the post processing comprises the hole-punching process.

8. An image forming system comprising:

the post processing apparatus according to claim 7; and an image forming apparatus that outputs the printing paper on which an image is formed to the post processing apparatus.

* * * * *